US007594704B2

(12) United States Patent
Boucherie

(10) Patent No.: US 7,594,704 B2
(45) Date of Patent: Sep. 29, 2009

(54) METHOD AND DEVICE FOR MANUFACTURING BRUSHES

(75) Inventor: Bart Gerard Boucherie, Izegem (BE)

(73) Assignee: Firma G.B. Boucherie, Naamloze Vennootschap, Izegem (BE)

( * ) Notice: Subject to any disclaimer, the term of this patent is extended or adjusted under 35 U.S.C. 154(b) by 904 days.

(21) Appl. No.: 10/868,949

(22) Filed: Jun. 17, 2004

(65) Prior Publication Data

US 2005/0001468 A1 Jan. 6, 2005

(30) Foreign Application Priority Data

Jul. 3, 2003 (BE) ..... 2003/0388

(51) Int. Cl.
*A46D 3/04* (2006.01)

(52) U.S. Cl. ..... 300/5; 300/7; 300/8; 300/21

(58) Field of Classification Search ..... 300/5, 300/7, 8, 12, 13, 21
See application file for complete search history.

(56) References Cited

U.S. PATENT DOCUMENTS

| | | | | |
|---|---|---|---|---|
| 3,059,972 | A * | 10/1962 | Schmidt | 300/5 |
| 4,733,917 | A * | 3/1988 | Boucherie | 300/7 |
| 5,165,759 | A * | 11/1992 | Lewis, Jr. | 300/21 |
| 5,518,301 | A * | 5/1996 | Boucherie | 300/21 |
| 6,016,757 | A * | 1/2000 | Boucherie | 112/80.01 |
| 6,145,935 | A * | 11/2000 | Boucherie | 300/7 |
| 6,905,176 | B2 * | 6/2005 | Boucherie | 300/21 |
| 2001/0026093 | A1 * | 10/2001 | Boucherie | 300/5 |
| 2004/0090108 | A1 * | 5/2004 | Boucherie | 300/21 |
| 2005/0001468 | A1 * | 1/2005 | Boucherie | 300/5 |
| 2005/0116528 | A1 * | 6/2005 | Boucherie | 300/5 |
| 2007/0145812 | A1 * | 6/2007 | Boucherie | 300/8 |

FOREIGN PATENT DOCUMENTS

| | | |
|---|---|---|
| CH | 374 967 A | 2/1964 |
| DE | 41 14 297 A1 | 11/1992 |
| EP | 0 018 021 | 10/1980 |
| EP | 0 304 110 | 2/1989 |
| EP | 0 346 965 | 12/1989 |
| EP | 0 681 796 | 11/1995 |

* cited by examiner

*Primary Examiner*—Lee D Wilson
(74) *Attorney, Agent, or Firm*—Bacon & Thomas, PLLC

(57) ABSTRACT

Method for manufacturing brushes, whereby bundles of fibers (2) are provided in openings (3) in a brush body (4) by a filling tool (5) of the type which at least consists of a bundle remover (7) for separating bundles of fibers (2) from a fiber magazine (8), a mechanism (9) for supplying fastening material (10) in order to fix the bundles of fibers (2) in the openings (3), a filling tool slide (11) moving to and fro to guide the bundles of fibers (2) to the brush body (4) and a needle (13) to put every bundle of fibers (2) concerned in the corresponding opening (3) together with a fastening element (14) formed of the fastening material (10), wherein at least the filling tool slide (11) is controlled by an individual electric drive element (27).

12 Claims, 2 Drawing Sheets

METHOD AND DEVICE FOR MANUFACTURING BRUSHES

BACKGROUND OF THE INVENTION

1. Field of the Invention

The present invention concerns a method and device for manufacturing brushes.

In particular, it concerns a device and method whereby bundles of fibers are provided in openings in a brush body by means of a filling tool of the type which at least consists of a bundle remover for separating bundles of fibers from a fiber magazine, a mechanism for supplying fastening material in order to fix the bundles of fibers in the openings, a filling tool slide moving to and fro to guide the bundles of fibers to the brush body and a needle to put every bundle of fibers concerned in the corresponding opening together with a fastening element formed of the fastening material.

The bundles of fibers are hereby fixed in the openings by means of fastening elements in the shape of clamps or anchors.

2. Discussion of the Related Art

Examples of such devices are described among others in EP 0,018,021, EP 0,346,965 and EP 0,681,796.

Traditionally, the filling tool slide as well as various other parts of the filling tool are controlled by means of a mechanical drive, in particular a cam drive.

In U.S. Pat. No. 3,059,972 it was already suggested to replace the mechanical drives by pneumatic or hydraulic drive means. As is described in this American patent, such pneumatic or hydraulic drive means work slower, however, than a mechanical drive. According to the patent, this is not problematic since, by making use of pneumatic or hydraulic drive means, it is easier to install several tools. It is clear, however, that the use of several tools represents a considerable cost and that more space is required to this end, as a result of which said solution is little economical.

However, the use of hydraulic or pneumatic drive means allows for an individual control, and the control moments can be easily altered, but it is disadvantageous in that an accurate adjustment of positions is rather difficult to realize.

Also, it is already known to control the supply of the fastening material for the bundles of fibers, in other words the wire out of which the anchor plates or the clamps are formed, by means of a positioning motor, which is described among others in DE 4,114,297. The use of a positioning motor is obvious here, as the fastening material only has to be supplied in one direction, namely the forward direction.

SUMMARY OF THE INVENTION

The present invention aims an improved method and device for manufacturing brushes, by means of which inserting bundles of fibers can be done in a smoother manner, and by means of which new control possibilities are created.

To this end, the invention in the first place concerns a method for manufacturing brushes, whereby bundles of fibers are provided in openings in a brush body by means of a filling tool of the type which at least consists of a bundle remover for separating bundles of fibers from a fiber magazine, a mechanism for supplying fastening material in order to fix the bundles of fibers in the openings, a filling tool slide moving to and fro to guide the bundles of fibers to the brush body and a needle to put every bundle of fibers concerned in the corresponding opening together with a fastening element formed of the fastening material, characterized in that at least the filling tool slide is controlled by means of an individual electric drive element that is controllable separately from other drive elements for other moving parts of the filling tool.

The use of an individual electric drive element, as opposed to the use of one common electric motor whose movement is transmitted to the different parts of the filling tool by means of a cam drive, offers the advantage that a drive is obtained which cannot only be controlled smoothly, but which can also operate very fast.

According to a preferred embodiment, the course of the filling tool slide is set or adjusted by means of a control of the electric drive element as a function of the brushes to be manufactured.

This offers the advantage that no unnecessary long course has to be followed, and that during the production of different brushes, it is easy to make an adjustment to the new course length.

More particularly, the course is preferably set as a function of the fiber length of the bundles of fibers to be provided in the openings.

Apart from the drive of the filling tool slide by means of an individual electric drive element, also other parts of the filling tool or of other related parts to be driven can be controlled by means of an individual electric drive element. Preferably, one or several, and better still each of the following parts are hereby concerned:

- the above-mentioned needle;
- the above-mentioned bundle remover;
- the above-mentioned mechanism for supplying the fastening material;
- a thread cutter for cutting off the fastening material, at least when such a thread cutter is used;
- a clamp shaper, at least when clamps are being used.

Preferably, use is made of a positioning motor for the above-mentioned electric drive elements, such as a servomotor, stepping motor or the like. Such a motor may consist of a rotating motor, whose rotational movement can be transformed in a linear movement where necessary by means of a suitable transmission, as well as of a linear motor, sometimes also called an actuating motor, whereby for example a first part which is provided with fixed magnets can be moved along a second part which is provided with electromagnets which can be actuated.

As is known, such a filling tool may also be equipped with additional accessories or related parts, such as for example a stop mechanism to prevent, as a function of the filling cycle to be completed, that fibers are taken from the wrong fiber magazine, etcetera. Preferably, all the movements of the filling tool or related parts will be controlled by means of individual electric drive elements in this case. Thus, the whole can be controlled entirely electrically, such that a time-consuming mechanical drive can be excluded.

It should be noted that the invention concerns a method and a device whereby a filling tool is used with only one filling tool slide, as well as whereby a filling tool is used with two filling tool slides or a filling tool slide composed of one or several moving parts. In that case, one or several of these filling tool slides or of the moving parts according to the invention can be provided with an individual electric drive element.

It should also be noted that by an 'individual electric drive element' is meant a drive element which operates rather locally that is, separately from other drive elements, whereby it is not excluded, however, that several parts can be simultaneously driven by means of such an 'individual electric drive element'. For, by 'individual' is meant that use is no longer made of a large common electric motor whose drive movement is transmitted to the different parts of the filling tool to be moved via a cam drive.

Taking into account what precedes, it is not excluded, for example, to control the needle and the filling tool slide by means of one common individual electric drive element, whereby, during the insertion of a bundle of fibers, a drive part is moved forward by means of said drive element, as a result of which the needle is shifted first and the filling tool slide is only shifted along after a specific shifting of the needle. Naturally, also other combinations are possible whereby different parts to be moved are controlled by means of a common individual electric drive element.

Secondly, the invention also concerns a device for manufacturing brushes, more particularly according to the above-mentioned method, of the type comprising a filling tool, which at least consists of a bundle remover for separating bundles of fibers from a fiber magazine, a mechanism for supplying fastening material in order to fix the bundles of fibers in the openings, a filling tool slide moving to and fro to guide the bundles of fibers to the brush body and a needle to put every bundle of fibers concerned in the corresponding opening together with a fastening element formed of the fastening material, characterized in that the filling tool slide is provided with an individual electric drive element.

Preferably, one or several of the following parts of the filling tool are also provided with an individual electric drive element:

- the above-mentioned needle;
- the above-mentioned bundle remover;
- the above-mentioned mechanism for supplying the fastening material;
- a thread cutter for cutting off the fastening material;
- a clamp shaper.

According to the invention, all electric drive elements concerned are preferably coupled to a control unit which provides for a synchronized control.

It should be noted that the drive by means of an individual electric drive element is also advantageous in combination with certain other parts than the filling tool slide, and in particular in combination with parts carrying out a to-and-fro movement, as it allows for a smooth control and setting. Taking this into account, the invention according to a special independent aspect also concerns a device for manufacturing brushes, of the type comprising a filling tool, whereby this filling tool comprises one or several of the following parts which can be moved to and fro:

- a thread cutter;
- a clamp shaper;
- a bundle remover;
- a needle;

characterized in that at least one of these parts is controlled by means of an individual electric drive element.

The notion 'electric drive element' should be interpreted in a broad sense, and not only electromagnetic drive systems are meant by it, such as rotating or linear electric motors, but also other drive elements, such as for example piezo-electric drive means.

BRIEF DESCRIPTION OF THE DRAWINGS

In order to better explain the characteristics of the invention, the following preferred embodiment is described as an example only without being limitative in any way, with reference to the accompanying drawings, in which.

DESCRIPTION OF THE PREFERED EMBODIMENT

Figure 1:
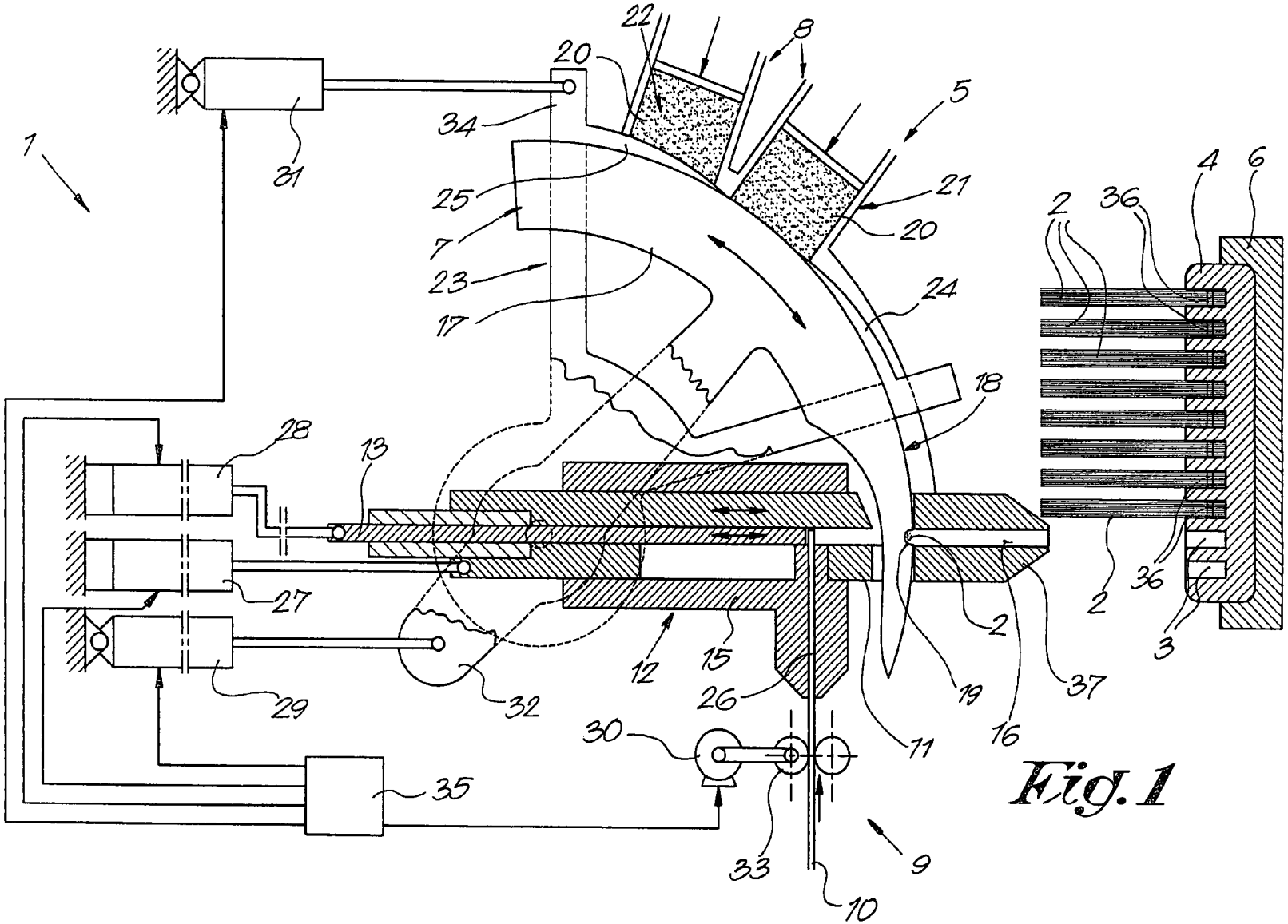
FIG. 1 schematically represents a device according to the invention.

As represented in the figures, the invention concerns a device 1 for providing bundles of fibers 2 in the openings 3 of a brush body 4, whereby use is made of a filling tool 5 to which the brush bodies 4 can be presented, for example clamped in a brush body holder 6.

The filling tool 5 mainly consists of a bundle remover 7 for separating bundles of fibers 2 from a fiber magazine 8, a mechanism 9 for supplying fastening material 10 to fix the bundles of fibers 2 in the openings 3, a filling tool slide 11 moving to and fro, which is situated in the actual tool 12, to guide the bundles of fibers 2 to the actual brush body 4, and a needle 13 to bring every bundle of fibers 2 concerned in the corresponding opening 3 together with a fastening element 14 made of the fastening material 10.

The filling tool slide 11 can hereby be moved in part 15 which is arranged in a fixed manner. In this filling tool slide 11 is formed a conveyance channel 16 in which the above-mentioned needle 13 can in turn be shifted.

The bundle remover 7 is made in the known manner in the shape of a half moon, and it consists of body 17 which can be rotated to and fro with a recess 19 in the circular outer edge 18 to take a number of fibers 20 out of the fiber magazine 8, in order to each time form a bundle of fibers 2.

In the case where a multiple fiber magazine 8 is used, as represented, with several fiber supply ducts 21-22, a mechanism 23 is provided which makes it possible to take fibers 20 as desired out of one or other fiber supply duct 21, 22 respectively. In the given example, this mechanism 23 is made in the manner as described in EP 0,681,796, whereby closing devices 24-25 can alternately be placed before either of the fiber supply ducts 21-22.

The mechanism 9 for supplying the fastening material 10 consists of a thread supply mechanism with a guide 26 which runs into the conveyance channel 16, such that the fastening material 10, which is formed for example of a metal wire or synthetic wire, can be supplied into the conveyance channel 16.

The invention is special in that at least the filling tool slide 11 is provided with an individual electric drive element 27, such as a positioning motor, in particular a servomotor or the like.

As represented, also the other parts to be driven can be equipped with an individual electric drive element. More particularly, use is made in the given example of an individual drive element 28 for the needle 13, an individual drive element 29 for the bundle remover 7, an individual drive element 30 for the supply of the fastening material 10 and an individual drive element 31 for the above-mentioned mechanism 23. All these drive elements 28-29-30-31 preferably also consist of servomotors, stepping motors or the like.

It is clear that transmission mechanisms can be provided between each of the drive elements 27 to 31 and the respective part to be shifted. In the given example, the drive elements 27 and 28 are coupled directly to the filling tool slide 11 and the needle 13. The drive element 29 works in conjunction with a lever 32 which is connected to the rotating bundle remover 7 in a fixed manner. The drive element 30 works in conjunction with a rotating pressure wheel 33, but other propelling mechanisms for the supply of the fastening material 10 are not excluded. The drive element 31 is coupled to a rotatable support 34 upon which the closing devices 24-25 are provided.

All drive elements 27 to 31 are coupled to a control unit 35 which makes it possible to control these drive elements in a synchronized manner.

The working of the device can be compared to these known devices, but with this difference that the drive now takes place via an electronic or electric control and by means of individual drive elements 27 to 31. For clarity's sake, the working is briefly illustrated hereafter. The bundle remover 7 is cyclically turned to and fro, such that the recess 19 each time moves along the fiber supply ducts 21-22. As a function of the position of the closing devices 24-25, fibers 20 are thus taken out of one or other fiber supply duct 21-22 and brought into the actual tool 12, which position is represented in FIG. 1.

Figure 2:
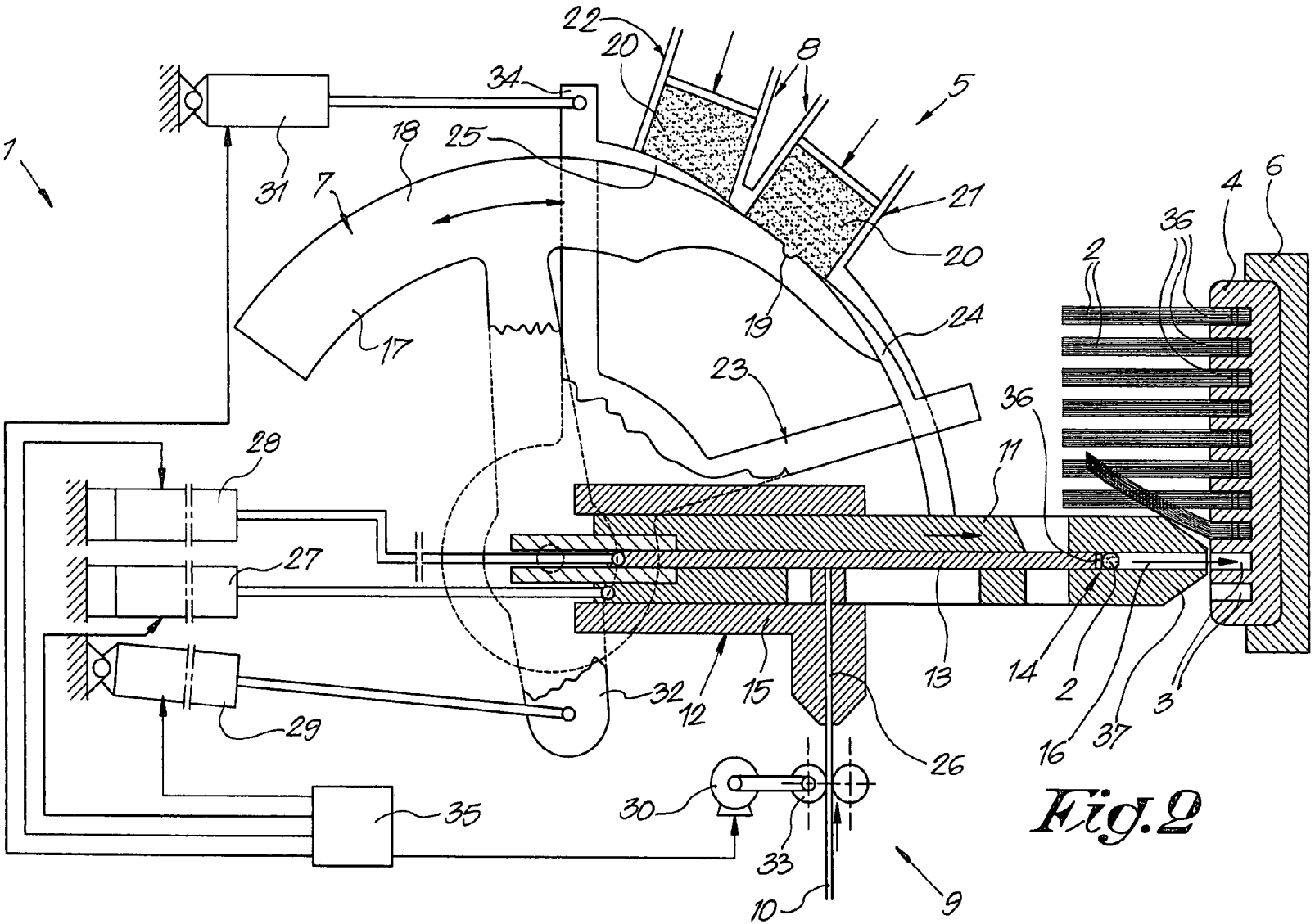
FIG. 2 represents the device of FIG. 2 in another position.

The filamentary fastening material 10 reaches with its front end into the conveyance channel 16. By subsequently shifting the slide 11 or the needle 13 forward, a piece of material of the filamentary fastening material 10 is cut off, such that for example, as represented in FIG. 2, an anchor plate 36 is formed. This anchor plate is shifted further forward through the needle 13, so that the bundle of fibers 20 which is present in the recess 19 is finally taken along forward, towards the front end 37 of the tool 12.

In the meantime, also the filling tool slide 11 is shifted up against the brush body 4, as represented in FIG. 2, such that the fiber bundle 2 is pressed down in the opening 3 concerned together with the anchor plate 36.

Next, the parts concerned move back in order to start a new cycle. When the needle 13 has been withdrawn into the position of FIG. 1, the fastening material 10 is shifted somewhat to the front by means of the drive element 30, such that an anchor plate can be cut off again during the next cycle.

According to the invention, the drive element 27 of the filling tool slide 11 preferably allows for an adjustable shift, such that the movement can be controlled as a function of the brushes to be manufactured, more particularly as a function of the length of the bundles of fibers 2.

The method of the invention can be easily derived from the above-described working of the device.

Although the figures exclusively represent an embodiment whereby use is made of anchor plates 36 for the fastening elements 14, it is clear that the invention can also be applied in embodiments whereby other fastening elements 14 are used, such as for example clamps, more particularly wire staples. In this case, the usual clamp shaper can also be controlled by means of one or several electric drive elements.

In the case of embodiments whereby the fastening material 10 is not cut off directly by means of the slide 11 or the needle 13, but by means of a special thread cutter, it is clear that such a thread cutter can also be controlled by means of an electric drive element in accordance with the present invention.

The present invention is by no means limited to the above-described embodiment given as an example and represented in the accompanying drawings; on the contrary, such a method and device for manufacturing brushes can be realized according to all sorts of variants while still remaining within the scope of the invention.

The invention claimed is:

1. A method for manufacturing brushes, wherein bundles of fibers are provided in openings in a brush body by means of a filling tool of the type which at least comprises a bundle remover for separating bundles of fibers from a fiber magazine, a mechanism for supplying fastening material in order to fix the bundles of fibers in the openings, a filling tool slide moving to and fro to guide the bundles of fibers to the brush body and a needle to put every bundle of fibers concerned in a corresponding opening together with a fastening element formed of the fastening material, and drive elements for said bundle remover, mechanism for supplying fastening material and needle, comprising controlling at least the filling tool slide by means of an individual electric drive element controllable separately from the other drive elements.

2. The method according to claim 1, wherein the course of the filling tool slide is set or adjusted by means of a control of the electric drive element as a function of the brushes to be manufactured.

3. The method according to claim 2, wherein the course is set as a function of the fiber length of the bundles of fibers to be provided in the openings.

4. The method according to claim 1, wherein one or more of:

the needle;

the bundle remover;

the mechanism for supplying the fastening material;

a thread cutter for cutting off the fastening material; and a clamp shaper;

are also controlled by means of respective individual electric drive elements.

5. The method according to claim 1, wherein for one or several of the electric drive elements use is made of a positioning motor.

6. The method according to claim 1, wherein all the movements of the filling tool or of related parts are controlled by means of individual electric drive elements.

7. In a device for manufacturing brushes comprising a filling tool, which at least includes a bundle remover for separating bundles of fibers from a fiber magazine, a mechanism for supplying fastening material in order to fix the bundles of fibers in the openings, a filling tool slide moving to and fro to guide the bundles of fibers to the brush body and a needle to put every bundle of fibers concerned in the corresponding opening together with a fastening element formed of the fastening material, and drive elements for said bundle remover, mechanism for supplying fastening material and needle, the improvement comprising, an individual electric drive element controllable separately from the other drive elements is provided for at least the filling tool slide.

8. The device according to claim 7, further including a thread cutter for cutting off the fastening material, and a clamp shaper;

wherein at least one of said needle, bundle remover, mechanism for supplying the fastening material, thread cutter and clamp shaper is provided with an individual electric drive element.

9. The device according to claim 7, wherein one or several of the electric drive elements comprises a positioning motor.

10. The device according to claim 7, wherein the bundle remover, needle mechanism for supplying the fastening material, thread cutter and clamp shaper each has an individual electric drive element.

11. The device according to claim 10, wherein all the electric drive elements are coupled to a control unit which is arranged to provide for a synchronized control of all the drive elements.

12. A device for manufacturing brushes comprising a filling tool, said filling tool comprising a plurality of parts selected from the group consisting of:

a thread cutter;

a clamp shaper;

a bundle remover; and a needle;

wherein said plurality of parts are each moveable to and fro by respective, individual electric drive elements, and wherein at least one of said plurality of parts is controlled by means of an individual electric drive element controllable separately from the electric drive element or electric drive elements of the other part or parts of said plurality of parts.

* * * * *

UNITED STATES PATENT AND TRADEMARK OFFICE

CERTIFICATE OF CORRECTION

PATENT NO. : 7,594,704 B2
APPLICATION NO. : 10/868949
DATED : September 29, 2009
INVENTOR(S) : Bart Gerard Boucherie It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1504 days.

Signed and Sealed this

Twenty-eighth Day of September, 2010

David J. Kappos

David J. Kappos
*Director of the United States Patent and Trademark Office*